United States Patent [19]

Kubota et al.

[11] 4,419,975

[45] Dec. 13, 1983

[54] AIR-FUEL RATIO CONTROL SYSTEM

[75] Inventors: Masaharu Kubota, Musashino; Ichiro Kudo, Tokyo; Masaaki Ohgami, Musashino, all of Japan

[73] Assignees: Fuji Jukogyo Kabushiki Kaisha, Tokyo; Nissan Motor Co., Ltd., Yokohama, both of Japan

[21] Appl. No.: 308,864

[22] Filed: Oct. 5, 1981

[30] Foreign Application Priority Data

Oct. 11, 1980 [JP] Japan ..... 55-142194

[51] Int. Cl.[3] ..... F02B 33/00

[52] U.S. Cl. ..... 123/440; 123/489

[58] Field of Search ..... 123/440, 489

[56] References Cited

U.S. PATENT DOCUMENTS

| | | | |
|---|---|---|---|
| 4,119,072 | 10/1978 | Asano | 123/440 |
| 4,291,659 | 9/1981 | Suzuki | 123/440 |
| 4,303,049 | 12/1981 | Ikeura | 123/440 |
| 4,327,689 | 5/1982 | Rachel | 123/440 |

*Primary Examiner*—Ronald B. Cox

*Attorney, Agent, or Firm*—Martin A. Farber

[57] ABSTRACT

An air-fuel ratio control system for an internal combustion engine having an emission control system with a three-way catalytic converter for controlling the air-fuel ratio in accordance with the temperature of the engine and operation of the engine. A temperature sensor for detecting the engine temperature and a negative pressure sensor for detecting the engine manifold vacuum in the induction passage are provided. A feedback control circuit is provided for controlling the air-fuel ratio to the stoichiometric air-fuel ratio in a normal operating condition and for stopping the control operation when the acceleration in the cold engine is detected by the temperature sensor and the negative pressure sensor. A first switch is provided to be actuated by the output of the negative pressure sensor to connect the output of the temperature sensor with the input of the feedback control circuit when the negative pressure is lower than a predetermined value. A second switch is provided to be actuated by the output of the negative pressure sensor to render the feedback control circuit inoperative as a feedback controller, whereby the air-fuel ratio is controlled by the output of the temperature sensor.

8 Claims, 8 Drawing Figures

AIR-FUEL RATIO CONTROL SYSTEM

BACKGROUND OF THE INVENTION

The present invention relates to an air-fuel ratio control system for an internal combustion engine which controls the air-fuel ratio of air-fuel mixture to an approximate value to the stoichiometric air-fuel ratio at which three-way catalyst acts most effectively and more particularly to an air-fuel ratio control system which is capable of reducing the CO content in exhaust gases at low engine temperature.

In a conventional air-fuel ratio control system, the air-fuel ratio of air-fuel mixture burned in cylinders of an engine is detected as an oxygen concentration of the exhaust gases by means of an $O_2$-sensor provided in the exhaust system of the engine, and judgement is made by the output signal from the $O_2$-sensor as to whether the signal is greater or smaller than the value corresponding to the stoichiometric air-fuel ratio, whereby electromagnetic valves for regulating the air to be mixed with the mixture are opened or closed, and accordingly the air-fuel ratio is controlled to the stoichiometric air-fuel ratio. In such an air-fuel ratio control system, while the throttle valve of the engine is fully opened at low engine temperature, the air-fuel mixture is enriched in order to improve driveability of the vehicle powered by the engine.

The conventional air-fuel ratio control system will be explained with reference to FIG. 1 which illustrates a schematic view of the system. The output from an $O_2$-sensor 25 for detecting oxygen concentration in the exhaust gases is applied to a feedback control circuit 26, the output of which is applied to an electromagnetic valve 27 for controlling the air feed rate to a carburetor, thus constituting a feedback control. Further, a negative pressure switch 28 which is turned on in accordance with a predetermined negative pressure in the induction passage of the engine is connected to a water temperature switch 29 which detects the temperature of cooling water and the output of the water temperature switch 29 is connected to the control circuit 26.

In this system, when the temperature of the engine cooling water is lower than a predetermined temperature, and also when the throttle valve is fully opened, which causes low negative pressure in the induction pipe (i.e. the area A in FIG. 2), the feedback control by the $O_2$-sensor 25 is cut out and a fixed rich air-fuel mixture is supplied to the engine. In the other operating condition (i.e. the area B in FIG. 2), the air-fuel ratio is controlled in dependency on the detected air-fuel ratio by the $O_2$-sensor 25. As shown in FIG. 3 illustrating the variation of the duty ratio under the conditions shown in FIG. 2, the duty ratio is certainly kept at a particular value under the condition of area A. However, in such a conventional system, because the duty ratio is kept at a particular value as long as the condition is in the area A, even if the engine is warmed up, an excessively rich air-fuel mixture is supplied, which will cause a large amount of CO discharge.

SUMMARY OF THE INVENTION

Accordingly, it is an object of the present invention to provide an air-fuel ratio control system which is capable of reducing CO discharge as well as of improving driveability by making the set value of the duty ratio variable in dependency on the temperature of cooling water.

According to the present invention, there is provided an air-fuel ratio control system for an internal combustion engine having an induction passage, a carburetor, an electromagnetic valve for correcting the air-fuel ratio of the air-fuel mixture supplied to the carburetor, an $O_2$-sensor for detecting oxygen concentration of exhaust gases, and a feedback control circuit responsive to the output of the $O_2$-sensor for producing control output signal for driving the electromagnetic valve for correcting the air-fuel ratio comprising first means for detecting the temperature of the engine for producing an output signal which varies with the temperature; second means for detecting the operation of the engine for producing an output signal when the throttle valve of the engine is widely opened; first switch means responsive to the output signal of the second means to connect output of the first means with input of the feedback control circuit; and second switch means responsive to the output signal of the second means to render the feedback control circuit inoperative as a feedback controller and operative as a controller for producing an output having a duty ratio for providing a rich air-fuel mixture; the feedback control circuit being so arranged that the duty ratio varies so as to increase the air-fuel ratio of the mixture as the temperature of the engine increases.

The other objects and features are explained more in detail with reference to the accompanying drawings.

DETAILED DESCRIPTION OF THE PREFERRED EMBODIMENTS

Figure 1:
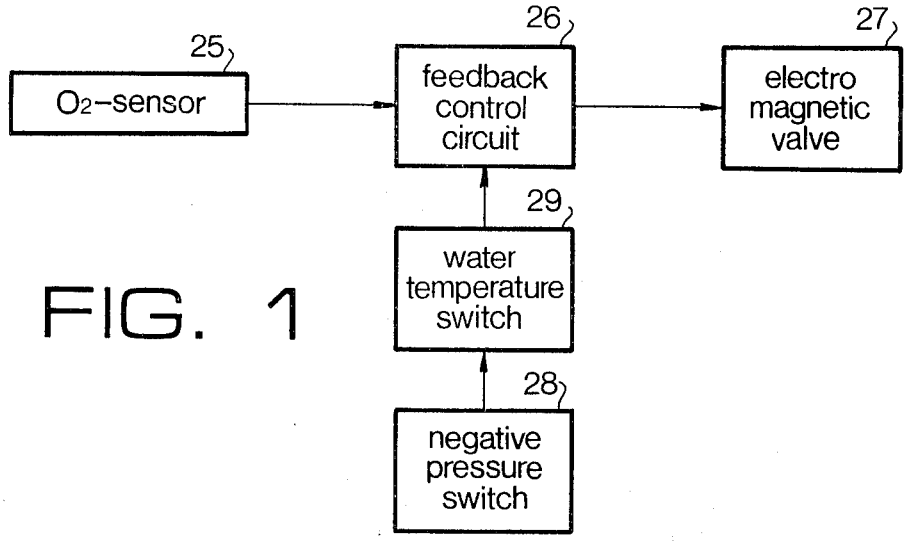
FIG. 1 is a schematic explanatory view of a conventional air-fuel ratio control system.
Figure 2:
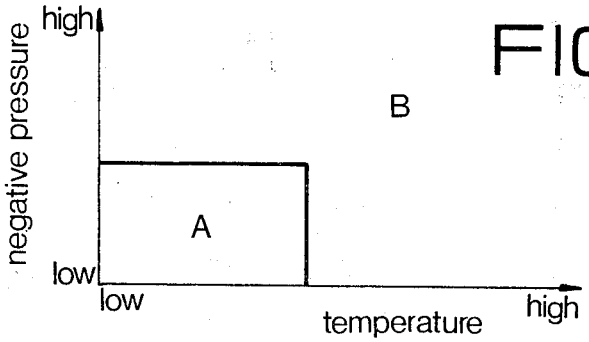
FIG. 2 is a graph showing an operation area distribution of the control system of FIG. 1.
Figure 3:
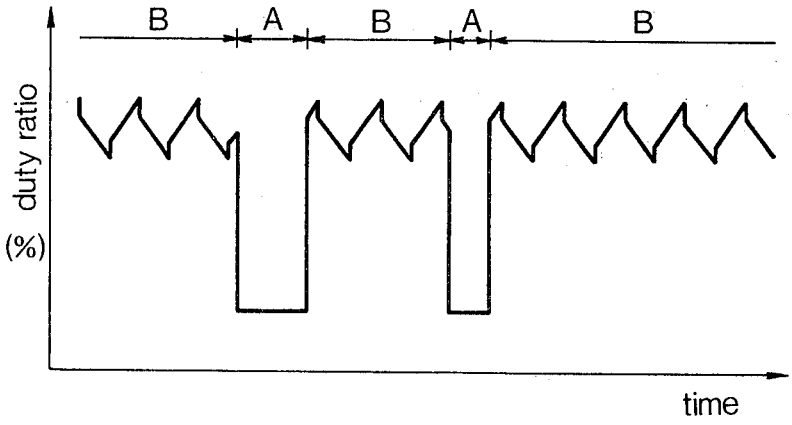
FIG. 3 is a graph showing the variation of duty ratio in accordance with the same.
Figure 4:
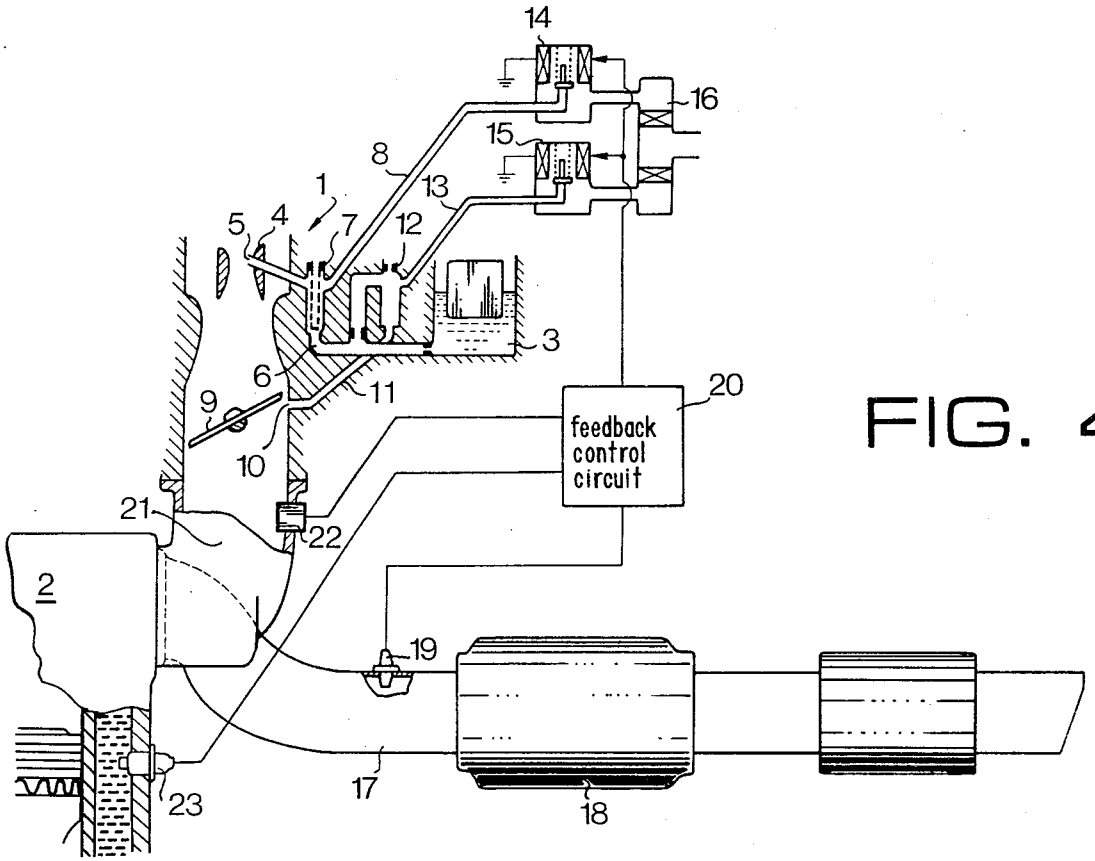
FIG. 4 is a schematic view of an air-fuel ratio control system according to an embodiment of the present invention.

Referring to FIG. 4 showing schematically the air-fuel ratio control system according to an embodiment of the present invention, a carburetor 1 is provided upstream of an engine 2, a correction air passage 8 communicating with an air-bleed 7 which is provided in a main fuel passage 6 between a float chamber 3 and a nozzle 5 of a venturi 4. Another correction air passage 13 communicates with another air-bleed 12 which is provided in a slow fuel passage 11 which diverges from the main fuel passage 6 and extends to a slow port 10 open in the vicinity of a throttle valve 9. These correction air passages 8 and 13 communicate with respective electromagnetic valves 14, 15, induction sides of which communicate with the atmosphere through an air cleaner 16. Further, a three-way catalytic converter 18 is provided in an exhaust pipe 17 at the downstream side of engine, and an $O_2$-sensor 19 is provided between the engine 2 and the converter 18 to detect oxygen concentration of the exhaust gases as a representation of the air-fuel ratio of the mixture burned in the cylinder of the engine.

Provided on an induction passage 21 of the engine 2 is a negative pressure sensor 22 which is actuated by the engine manifold vacuum in the induction pipe, and provided on the water jacket of the engine is a water temperature sensor 23 to detect the temperature of engine cooling water.

A feedback control circuit 20 applied with outputs from these sensors 19, 22 and 23 produces an output signal to actuate the electromagnetic valves 14, 15 to open and close at a certain duty ratio according to the output signal. The air-fuel ratio is made lean by supplying correction air to the carburetor at a great feed rate and the air-fuel ratio is made rich by reducing the correction air supply.

Figure 5:
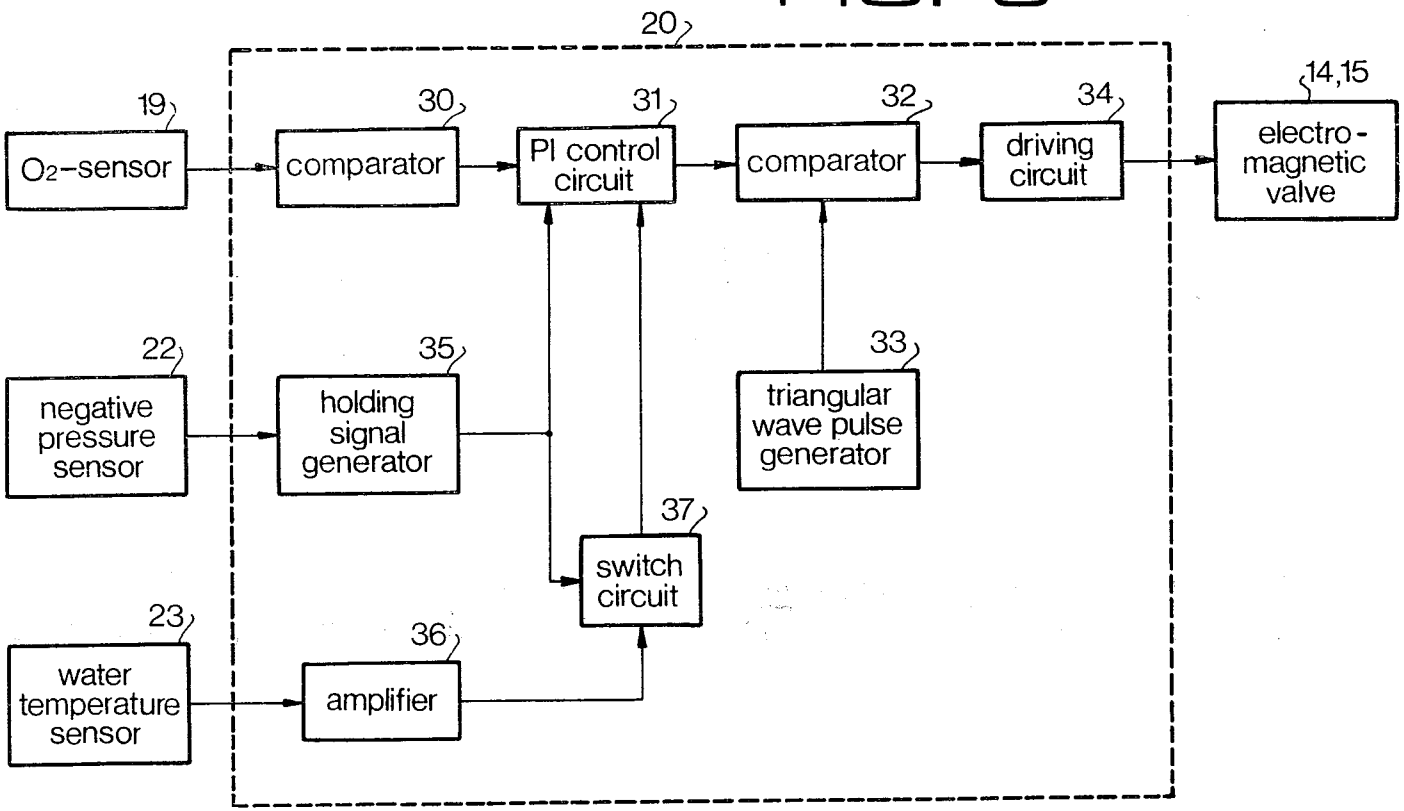
FIG. 5 is a block diagram of the control system of the same.

Referring to FIG. 5 which is a block diagram showing the construction of the control system 20, the output of the $O_2$-sensor 19 is applied to a PI (proportion and integration) control circuit 31 through a comparator 30; the output of the PI control circuit 31 is applied to a comparator 32; and a triangular wave signal from a triangular wave pulse generator 33 is applied to the comparator 32. A driving circuit 34 is applied with square wave pulses from the comparator 32 to drive the electromagnetic valves 14, 15.

Receiving the output of the negative pressure sensor 22, a holding signal generator 35 produces holding signals when the negative pressure in the induction passage 21 becomes lower than a predetermined value at a wide throttle open, and sends them to the PI control circuit 31 and a switch circuit 37. The water temperature sensor 23 is of a type which provides a continuous measurement of the cooling water temperature. The detecting signal of the water temperature sensor 23 is applied to the PI control circuit 31 through an amplifier 36 and the switch circuit 37.

Figure 6:
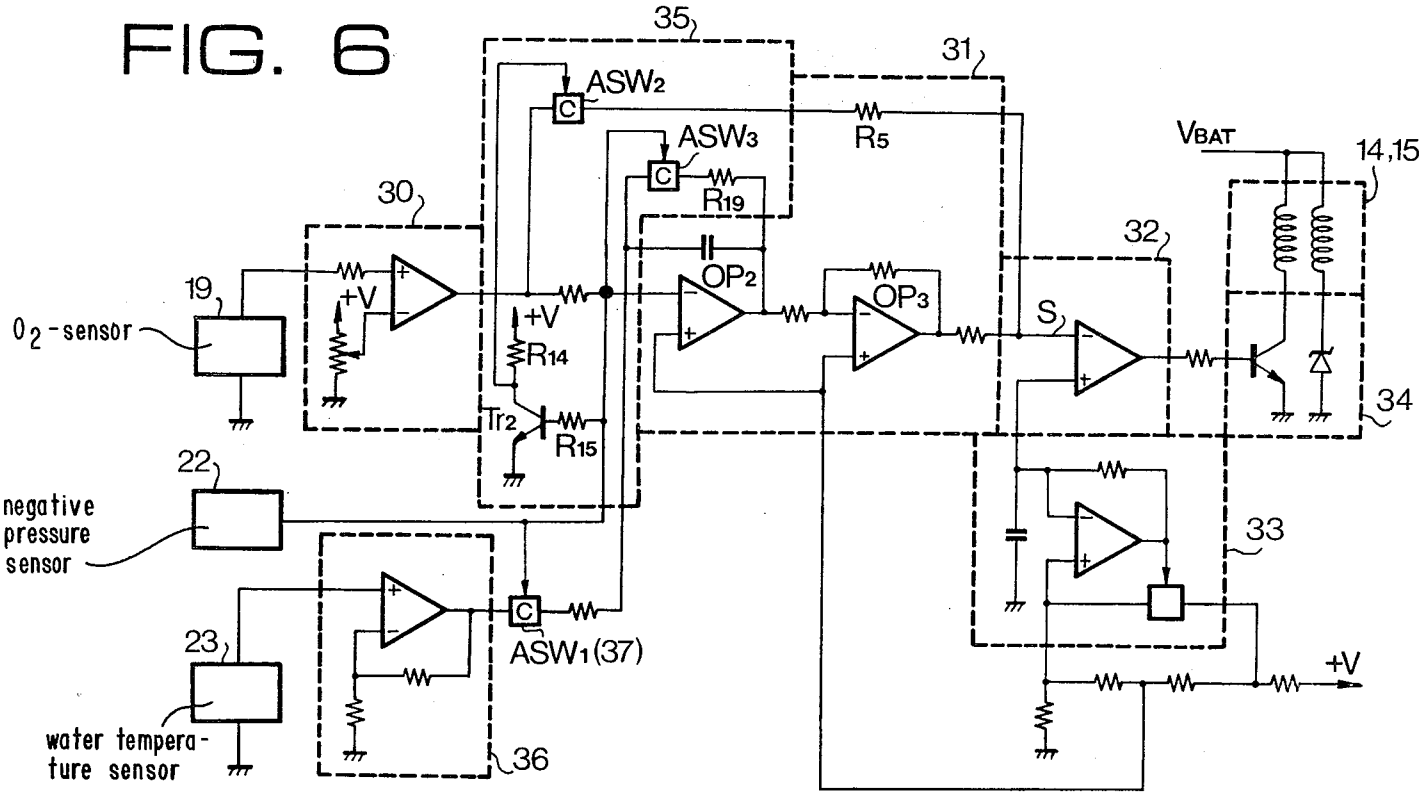
FIG. 6 is an electric circuit embodying the same.

FIG. 6 is an electric circuit of the control circuit shown in FIG. 5. The PI control circuit 31 is constituted of two operational amplifiers $OP_2$, $OP_3$, a capacitor, and resistors, which are arranged to produce an integration output in proportion to the input signal.

The holding signal generator 35 comprises resistors $R_{14}$, $R_{15}$, $R_{19}$, a transistor $Tr_2$, and analog switches $ASW_2$, $ASW_3$. The analog switch $ASW_2$ and resistor $R_5$ are connected between the input and output of the PI control circuit 31 in series. The analog switch $ASW_3$ and resistor $R_{19}$ are connected between the input and output of the operational amplifier $OP_2$ in series. The output of the negative pressure sensor 22 is connected to the control gate of analog switch $ASW_1$ (identical with switch circuit 37) and to the control gate of analog switch $ASW_3$ and further connected to the base of transistor $Tr_2$. The collector of the transistor $Tr_2$ is applied with a voltage and also connected to the control gate of analog switch $ASW_2$.

The following explains the operation of the present invention.

When negative pressure in the induction passage is high

The negative pressure sensor 22 produces a low level signal and analog switches $ASW_1$, $ASW_3$ are turned off, while the transistor $Tr_2$ is off, and accordingly, the analog switch $AWS_2$ is on. The output signal of the $O_2$-sensor 19 is applied to the comparator 30, where the output signal of the $O_2$-sensor 19 is compared with a standard signal corresponding to the stoichiometric air-fuel ratio for comparing the air-fuel ratio of the mixture. The output of the comparator 30 is applied to the PI control circuit 31 which produces a proportional and integrated output. The output is compared with the triangular wave signal from triangular wave generator 33 in the comparator 32 to produce square wave pulses. The square wave pulses are sent to the electromagnetic valves 14, 15 through the driving circuit 34. Thus, the air-fuel ratio of the mixture is controlled to the stoichiometric air-fuel ratio.

When the cooling water temperature is low and the negative pressure in the induction passage is low When the throttle valve 9 is fully opened for accelerating or heavy load driving the negative pressure in the induction passage 21 becomes low. The negative pressure sensor 22 detects such a variation of the negative pressure and produces a high level signal to turn on switches $ASW_1$, $ASW_3$, when the negative pressure drops under the predetermined value. Simultaneously the transistor $Tr_2$ is turned on by the high level signal to thereby turn off the switch $ASW_2$. Therefore, the operational amplifier $OP_2$ does not function as an integrator. Thus, the PI control circuit 31 acts as a mere amplifier. On the other hand, because the analog switch $ASW_1$ is turned on, the output of the amplifier 36 is connected to the operational amplifier $OP_2$. Thus, the operational amplifier $OP_2$ operates to amplify the outputs of the $O_2$-sensor 19 and the water temperature sensor 23, and the amplified output is transmitted to the comparator 32 to produce square wave pulses. Therefore, the duty ratio of the pulses for driving the electromagnetic valves 14, 15 is adjusted by the water temperature, so that a proper air-fuel mixture is supplied to the engine.

Figure 7:
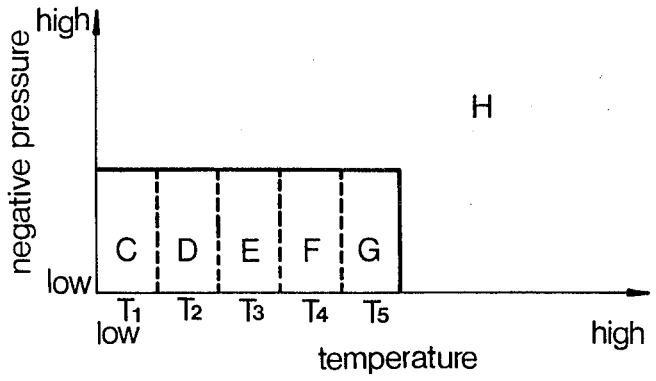
FIG. 7 is a graph showing an operation area distribution of the same.
Figure 8:
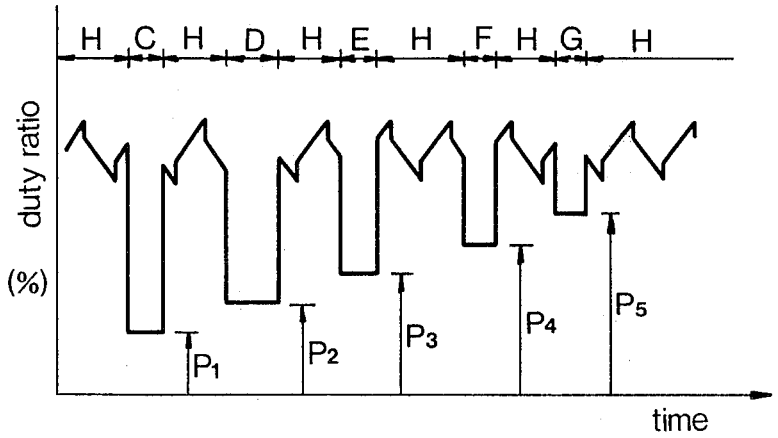
FIG. 8 is a graph showing variation of the duty ratio.
Figure 6:
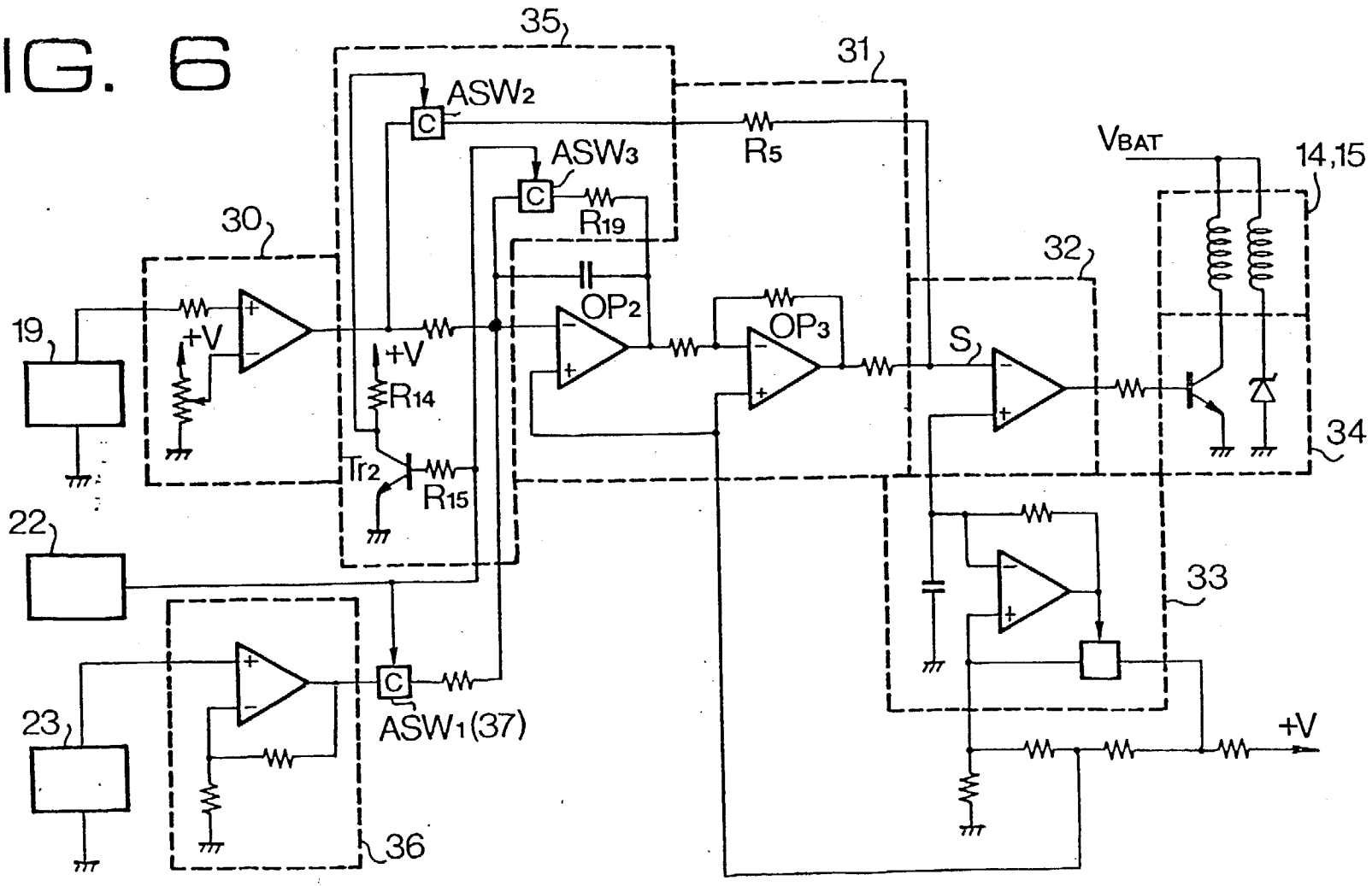

Referring to FIGS. 7 and 8, a function of the system is explained as follows.

When the water temperature is lower than $T_5$ and negative pressure is lower than a predetermined value represented by the horizontal line in FIG. 7, the duty ratio is decreased to a low value and varies with the temperature. In a zone H which is outside of the above-mentioned condition, PI control is carried out. The output waveforms at the output point S of the control circuit 31 are shown in FIG. 8. The duty ratio at the low water temperature between C and G in FIG. 7 varies as $P_1$–$P_5$. Thus, when the water temperature is extremely low, the duty ratio decreases so as to supply extremely rich air-fuel mixture to the engine 2 (at ratio $P_1$), and as the water temperature is elevated, the concentration of the air-fuel mixture is made leaner ($P_2$–$P_5$).

According to the system of the present invention, in the event of a low water engine temperature and a low negative pressure (that is, acceleration or heavy load driving), the concentration of the induced air-fuel mixture in the induction passage can be corrected to a proper value in relation to the engine temperature, whereby the driveability at a low engine temperature is improved and the amount of CO discharge may be reduced.

What is claimed is:

1. In an air-fuel ratio control system for an internal combustion engine having an induction passage, a carburetor, an electromagnetic valve for correcting the air-fuel ratio of the air-fuel mixture supplied to said carburetor, an $O_2$-sensor for detecting oxygen concentration of exhaust gases and producing an $O_2$ output signal dependent thereon, and a feedback control circuit having an input receiving said output signal, said feedback control circuit being operative as a feedback controller responsive to the output signal of said $O_2$-sensor for producing a control output signal for driving said electromagnetic valve for correcting the air-fuel ratio; the improvement comprising first means for detecting the temperature of said engine for producing an output signal which varies with the temperature;

second means for detecting the operation of said engine for producing an output signal only when the throttle valve of the engine is widely opened;

first switch means responsive to said output signal of said second means for connecting the output signal of said first means to the input of said feedback control circuit together with the output of said $O_2$-sensor; and second switch means responsive to said output signal of said second means to render said feedback control circuit inoperative as the feedback controller and operative as a controller means for producing an output signal so as to provide a duty ratio for providing rich air-fuel mixture independent on the output signals of said $O_2$-sensor and said first means;

said controller means being such that said duty ratio varies so as to increase the air-fuel ratio of the mixture as the temperature of said engine increases.

2. An air-fuel ratio control system for an internal combustion engine in accordance with claim 1 wherein said feedback control circuit comprises a proportion and integration circuit and said second switch means is provided to render said proportion and integration circuit inoperative as an integrator and operative as an amplifier.

3. An air-fuel ratio control system for an internal combustion engine in accordance with claim 1 wherein said first means is a cooling water temperature sensor and said second means is a negative pressure sensor actuated by negative pressure in said induction passage.

4. The air-fuel ratio control system according to claim 2, wherein said second switch means comprises a first analog switch connected in series with a resistor in parallel across said proportion and integration circuit and has a first gate, and a second analog switch connected in series with a resistor in parallel across an integrating portion of said proportion and integrating circuit and said has a second gate, a transistor is operatively connected between said first gate and said second detecting means, and said second detecting means is connected to said second gate and to a gate of said first switch means, the latter constituting a third analog switch operatively connected between said first detecting means and the input of said proportion and integration circuit.

5. The air-fuel ratio control system according to claim 4, wherein said first analog switch is a normally on switch and said second and third analog switches are normally off switches, the condition of said switches reversing in response to said output signal of said second detecting means.

6. The air-fuel ratio control system according to claim 4, further comprising an operational amplifier with resistance feedback connected between said first detecting means and said third analog switch.

7. The air-fuel ratio control system according to claim 1, wherein said controller means being such that said duty ratio varies stepwise so as to increase the air-fuel ratio of the mixture as the temperature of said engine increases.

8. The air-fuel ratio control system according to claim 1, wherein said controller means acts as a simple amplifier.

* * * * *

UNITED STATES PATENT AND TRADEMARK OFFICE

CERTIFICATE OF CORRECTION

PATENT NO. : 4,419,975

DATED : December 13, 1983

INVENTOR(S) : Masaharu Kubota, et al

It is certified that error appears in the above-identified patent and that said Letters Patent are hereby corrected as shown below:

Please correct Fig. 6 of the drawing as shown on the attached copy of Fig. 6.

Signed and Sealed this

*Fifteenth* Day of *May 1984*

[SEAL]

*Attest:*

*Attesting Officer*

GERALD J. MOSSINGHOFF

*Commissioner of Patents and Trademarks*